US010907581B2

(12) United States Patent
Moroi et al.

(10) Patent No.: US 10,907,581 B2
(45) Date of Patent: Feb. 2, 2021

(54) INTERNAL COMBUSTION ENGINE

(71) Applicant: HONDA MOTOR CO., LTD., Tokyo (JP)

(72) Inventors: Atsushi Moroi, Wako (JP); Yuki Hase, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/776,969

(22) Filed: Jan. 30, 2020

(65) Prior Publication Data

US 2020/0271076 A1 Aug. 27, 2020

(30) Foreign Application Priority Data

Feb. 25, 2019 (JP) ..... 2019-031499

(51) Int. Cl.

| | |
|---|---|
| ***F02M 35/10*** | (2006.01) |
| ***F02M 7/17*** | (2006.01) |
| *F01P 5/06* | (2006.01) |
| *F02B 75/16* | (2006.01) |
| *F02B 75/02* | (2006.01) |
| *F02B 75/18* | (2006.01) |
| *F02F 1/00* | (2006.01) |

(52) U.S. Cl.

CPC ..... *F02M 7/17* (2013.01); *F02M 35/1017* (2013.01); *F01P 5/06* (2013.01); *F02B 75/16* (2013.01); *F02B 2075/027* (2013.01); *F02B 2075/1808* (2013.01); *F02B 2275/34* (2013.01); *F02F 1/002* (2013.01)

(58) Field of Classification Search

CPC ..... F02M 7/17; F02M 35/1017; F01P 5/06; F02B 75/16

See application file for complete search history.

(56) References Cited

U.S. PATENT DOCUMENTS

| | | | | |
|---|---|---|---|---|
| 1,925,684 A | | 9/1933 | Anschicks | |
| 3,889,649 A | * | 6/1975 | Polaner | F02M 25/06 123/572 |
| 5,937,816 A | | 8/1999 | Wincewicz et al. | |
| 6,082,343 A | | 7/2000 | Oishi et al. | |
| 2013/0098325 A1 | | 4/2013 | Fukushima et al. | |

FOREIGN PATENT DOCUMENTS

| | | |
|---|---|---|
| JP | S5013013 U | 2/1975 |
| JP | S5020014 U | 3/1975 |
| JP | S5168948 U | 5/1976 |

(Continued)

OTHER PUBLICATIONS

EPO Extended European Search Report for Application No. 20156322.8 dated May 8, 2020; 6 pp.

(Continued)

*Primary Examiner* — Kevin A Lathers

(74) *Attorney, Agent, or Firm* — Armstrong Teasdale LLP

(57) ABSTRACT

An internal combustion engine (10) fitted with a carburetor (40) is provided with a fire-resistant cover member (62) having a front wall (65A) facing an air inlet port (44) of the carburetor, and a breather tube (60) having an inlet end (60A) connected to a crank chamber (28) of the internal combustion engine main body, and an outlet end (60B) supported by the cover member at a position located between the front wall and the carburetor.

12 Claims, 10 Drawing Sheets

(56) References Cited

FOREIGN PATENT DOCUMENTS

| | | | |
|---|---|---|---|
| JP | S5258347 | U | 4/1977 |
| JP | S632859 | U | 1/1988 |
| JP | H10159534 | A | 6/1998 |
| JP | 2000345930 | A | 12/2000 |
| JP | 2002098014 | A | 4/2002 |
| JP | 2004144010 | A | 5/2004 |
| JP | 2014034941 | A | 2/2014 |
| JP | 2017072078 | A | 4/2017 |
| WO | 2009087163 | A1 | 7/2009 |

OTHER PUBLICATIONS

JPO Notice of Reasons for Refusal for Japanese Patent Application No. 2019-031499 dated Sep. 8, 2020; 5 pp.
European Office Action regarding Patent Application No. 20 156 322.8 dated Dec. 17, 2020; pp. 1-25.

* cited by examiner

INTERNAL COMBUSTION ENGINE

TECHNICAL FIELD

The present invention relates to an internal combustion engine.

BACKGROUND ART

In an internal combustion engine, it is known to return blow-by gas generated in a crank chamber to an intake pipe via a breather tube (see JPH10-159534A, for example). The outlet end of the breather tube is connected to the intake pipe which is connected to the carburetor. Owing to the negative pressure existing in the intake pipe, the blow-by gas is drawn into the cylinder via the intake pipe.

The intake pipe, the air cleaner, and the muffler of an internal combustion engine are designed in different ways for different applications. For instance, the surrounding air may be directly drawn into an air inlet port of the carburetor for a certain application, instead of using an air cleaner and an intake pipe. In such a case, there is a need to create an intake passage within the carburetor to allow the blow-by gas to be drawn into the intake system of the internal combustion engine. This requires the carburetor to be re-designed specifically for this particular application.

SUMMARY OF THE INVENTION

In view of such a problem of the prior art, a primary object of the present invention is to provide an internal combustion engine which allows an outlet end of a breather tube to be connected to an upstream side of a carburetor without requiring an intake pipe and without requiring a major modification of the carburetor.

To achieve such an object, the present invention provides an internal combustion engine (10), comprising: a carburetor (40) connected to an intake port (32) of an internal combustion engine main body (26); a fire-resistant cover member (62) having a front wall (65A) facing an air inlet port (44) of the carburetor; and a breather tube (60) having an inlet end (60A) connected to a crank chamber (28) of the internal combustion engine main body, and an outlet end (60B) supported by the cover member at a position located between the front wall and the carburetor.

The cover member has the function of protecting other components surrounding the carburetor from the backfire which may issue from the air inlet port of the carburetor. According to the present invention, the cover member is conveniently used for supporting the outlet end of the breather tube. Thus, the outlet end of the breather tube can be communicated with the air inlet port of the carburetor without requiring any major additional member or component. Further, even though the outlet end of the breather tube is simply positioned between the front wall of the cover member and the carburetor without using any air tight fitting or the like, owing to the existence of the flow of the fresh intake air into the air inlet port of the carburetor, the blow-by gas flowing out of the outlet end of the breather tube can be entirely drawn into the air inlet port of the carburetor without the risk of releasing the blow-by gas to the atmosphere.

Preferably, the cover member further includes a lower wall (65B) extending from a lower edge of the front wall toward the carburetor, and having a cover member opening (74) passed vertically through the lower wall.

The fresh air can be drawn into the air inlet port of the carburetor via the cover member opening in the lower wall, and any liquid such as moisture and oil which may deposit inside the cover member can be expelled from the cover member opening.

Preferably, an open space (81) is defined under the cover member.

Thereby, the liquid which may drip down from the cover member opening is prevented from contaminating any auxiliary device or the engine main body.

Preferably, the lower wall is provided with a tube supporting portion (75) receiving the outlet end of the breather tube therein, and the outlet end of the breather tube is located higher than the inlet end of the breather tube, the outlet end of the breather tube having an outlet end opening facing upward.

The liquid such as oil that may be present in the breather tube flows toward the inlet end of the breather tube under the gravitational force so that the liquid is prevented from reaching the interior of the cover member or into the air inlet port of the carburetor.

Preferably, the outlet end of the breather tube projects upward from an upper surface of the lower wall.

Thereby, the outlet end of the breather tube is placed near the intake port of the carburetor so that the blow-gas is prevented from being released to the atmosphere.

Preferably, the outlet end opening of the breather tube is located lower than a center of the air inlet port of the carburetor.

Thereby, the liquid which could be released from the outlet end of the breather tube is prevented from being drawn into the air inlet port of the carburetor.

Preferably, a center (C1) of the air inlet port of the carburetor is located, as viewed from an axial direction of the air inlet port, between a second line (L2) which is orthogonal to a first line (L1) extending between a center (C2) of the outlet end opening of the outlet end of the breather tube and a center (C3) of the cover member opening and extends through the center (C2) of the outlet end opening of the breather tube, and a third line (L3) orthogonal to the first line (L1) and extending through the center (C3) of the cover member opening.

Thereby, the blow-by gas expelled from the outlet end of the breather tube passes by the air inlet port of the carburetor, and is drawn into the air inlet port of the carburetor before reaching the cover member opening so that the blow-by gas is prevented from being released to the atmosphere via the cover member opening.

Preferably, a distance (D1) between a center (C2) of the outlet end opening of the breather tube and a center (C1) of the air inlet opening of the carburetor is smaller than a distance (D2) between the center (C2) the outlet end opening of the breather tube and a center (C3) of the cover member opening.

Since the air inlet opening of the carburetor is nearer to the outlet end opening of the breather tube than the cover member opening, the blow-by gas is drawn into the air inlet opening of the carburetor without being released to the atmosphere via the cover member opening in a particularly reliable manner.

Preferably, the air inlet port of the carburetor and the cover member opening are dimensioned so that a space defined by the cover member jointly with an outer surface of the carburetor is placed under a negative pressure due to a reciprocating movement of a piston (31) of the internal combustion engine.

Thereby, the blow-by gas is drawn into the air inlet opening of the carburetor without being released to the atmosphere in a particularly reliable manner.

Preferably, the internal combustion engine further includes an outer cover (11) covering the internal combustion engine main body, and the carburetor, the cover member and the breather tube are placed inside the outer cover.

Thereby, the breather tube is protected from influences of the surrounding temperature since the interior of the outer cover is maintained at a raised temperature owing to the heat of the engine. Therefore, the moisture contained in the blow-by gas is prevented from freezing inside the breather tube.

Preferably, the cover member is made of stamp formed sheet metal.

Thereby, the manufacturing process is simplified, and the manufacturing cost is minimized.

Preferably, the cover member is provided with a pair of legs (65C) extending from lateral sides of the front wall and attached to the carburetor, and an upper wall (64B) extending from an upper edge of the front wall to a part at least adjoining an outer surface of the carburetor or from the carburetor to a part at least adjoining the front wall.

Thereby, the space defined between the front wall and the outer surface of the carburetor can be closed from above with the upper wall which can be formed simply by bending the sheet metal or adding a strip of sheet metal.

According to a preferred embodiment of the present invention, the air inlet port of the carburetor faces in a lateral direction, and the cover member includes a first member (64) and a second member (65) fastened to the first member, wherein the first member includes a base plate (64A) secured to an end surface of the carburetor and having a through hole (67) communicating with the air inlet port of the carburetor, and an upper wall extending from an upper edge of the base plate away from the carburetor, and the second member includes the front wall (65A) opposing the base plate, a lower wall (65B) extending from a lower edge of the front wall toward the base plate, and a pair of legs (65C) extending from either side edge of the front wall and attached to the base plate, the lower wall being provided with a cover member opening (74) passed vertically therethrough.

Thereby, even when the carburetor is small in size, the cover member for defining the space for placing the outlet end of the breather tube can be manufactured both easily and economically.

The present invention thus provides an internal combustion engine which allows an outlet end of a breather tube to be connected to an upstream side of a carburetor without requiring an intake pipe and without requiring a major modification of the carburetor.

BRIEF DESCRIPTION OF THE DRAWING(S)

DESCRIPTION OF THE PREFERRED EMBODIMENT(S)

An internal combustion engine according to the present invention as applied to a snow blower is described in the following with reference to the appended drawings.

Figure 1:
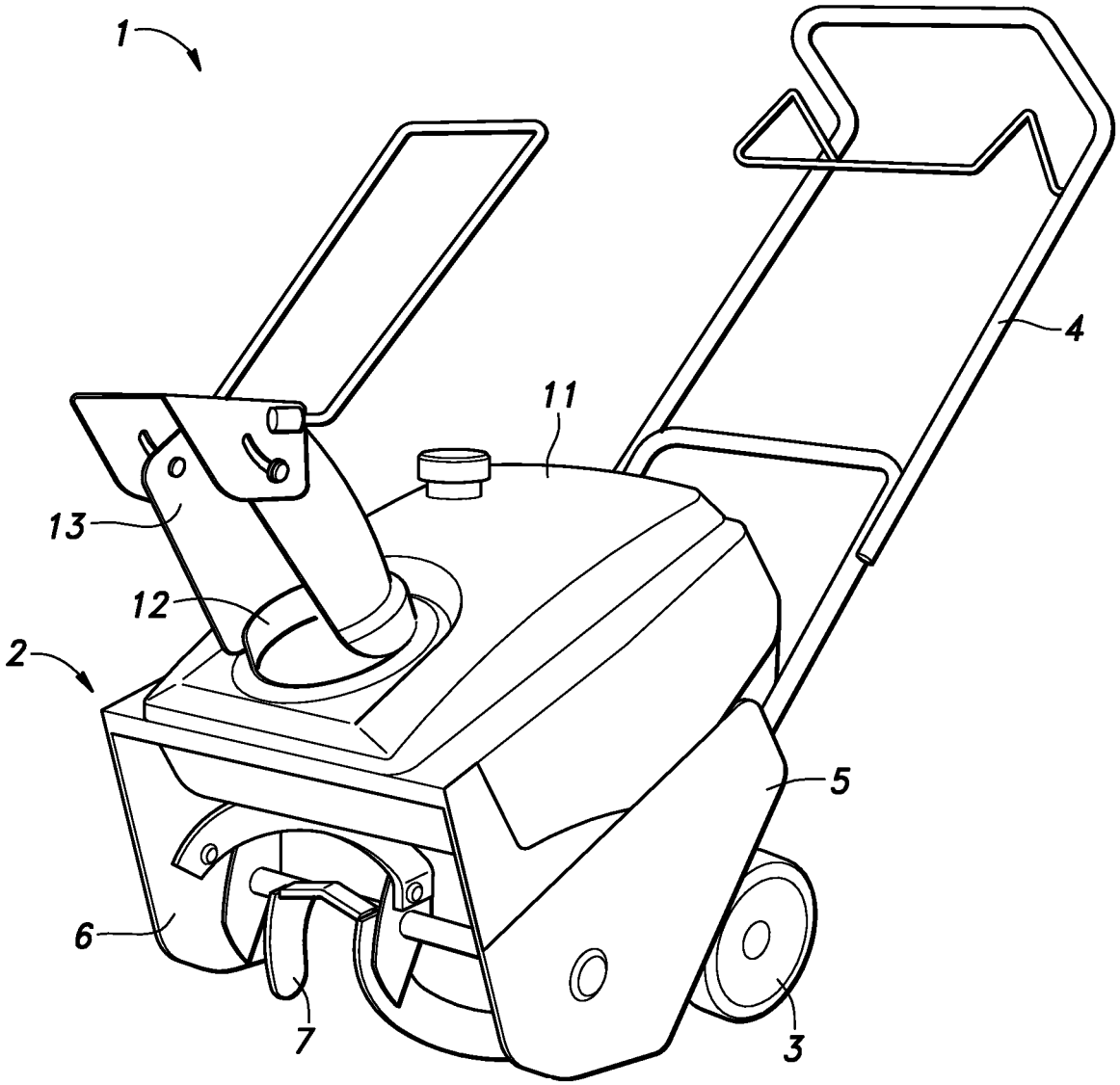
FIG. 1 is a perspective view of a snow blower to which an internal combustion engine according to a first embodiment of the present invention is applied.
Figure 2:
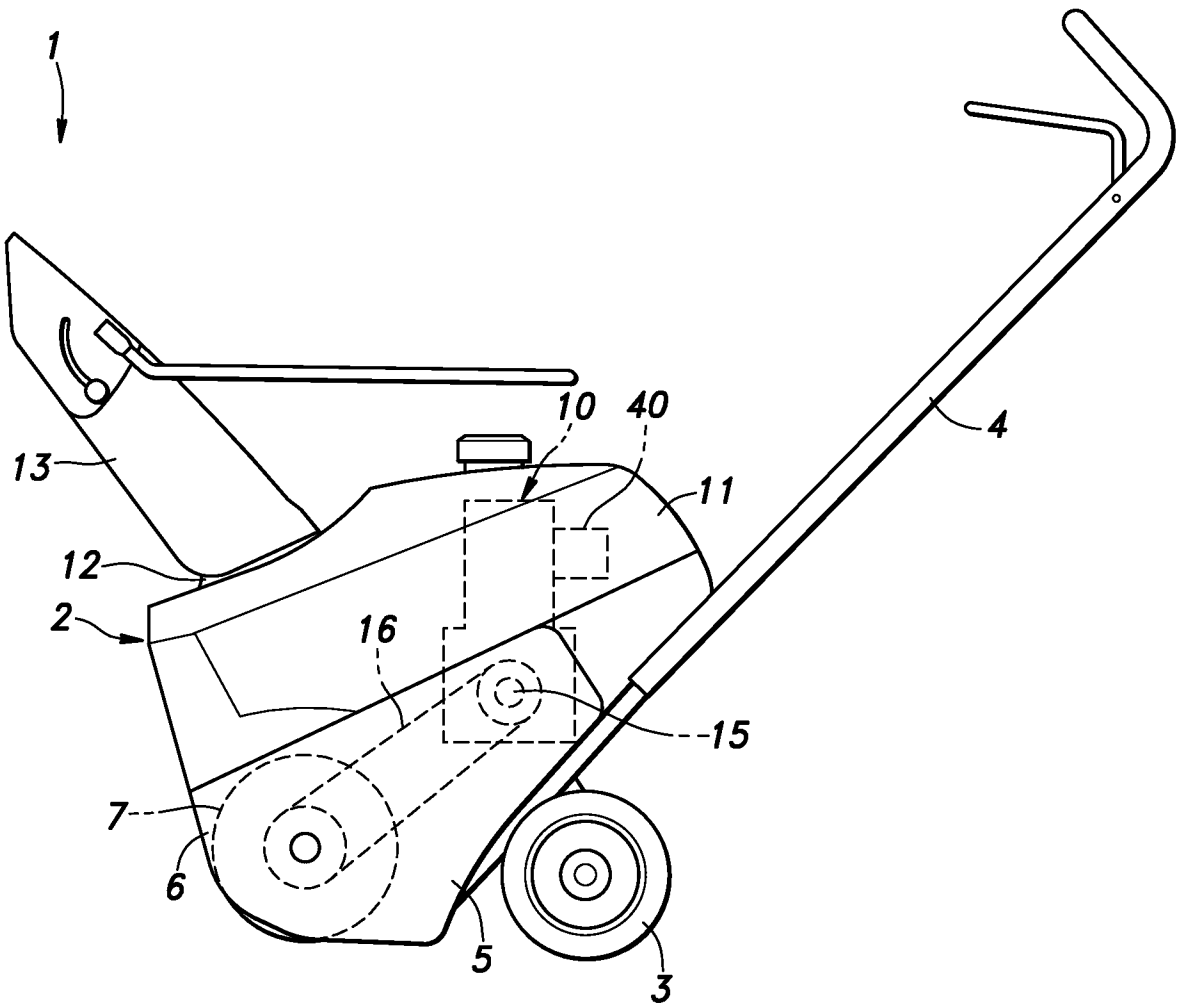
FIG. 2 is a side view of the snow blower.

As shown in FIGS. 1 and 2, the snow blower 1 includes a main body 2, a pair of wheels 3 provided at a lower rear part of the main body 2, and a handle bar 4 extending rearward and upward from the main body 2. The main body 2 includes a main body frame 5, an auger housing 6 provided in a front part of the main body frame 5, an auger 7 rotatably supported by the auger housing 6 therein, and an internal combustion engine 10 mounted on an upper rear part of the main body frame 5 to drive the auger 7. The snow blower 1 further includes an outer cover 11 provided on the upper part of the main body frame 5 to cover the internal combustion engine 10, a chute 12 extending upward from the auger housing 6 through the outer cover 11, and a guide cone 13 provided in an upper end of the chute 12.

The auger housing 6 has an open side facing forward and downward. The auger 7 is rotatably supported by the auger housing 6 about a laterally extending rotary shaft, and is exposed in the forward and downward direction from the auger housing 6. The auger 7 is connected to a crankshaft 15 of the internal combustion engine 10 via a belt and pulley mechanism 16. The auger 7 rotates under the driving force of the internal combustion engine 10. As the auger 7 rotates, the snow is scraped into the auger housing 6. A rotating impeller (not shown) provided in the chute 12 discharges the snow scraped into the auger housing 6 to the outside through the chute 12. The guide cone 13 adjusts the direction in which the snow is discharged from the chute 12.

Figure 3:
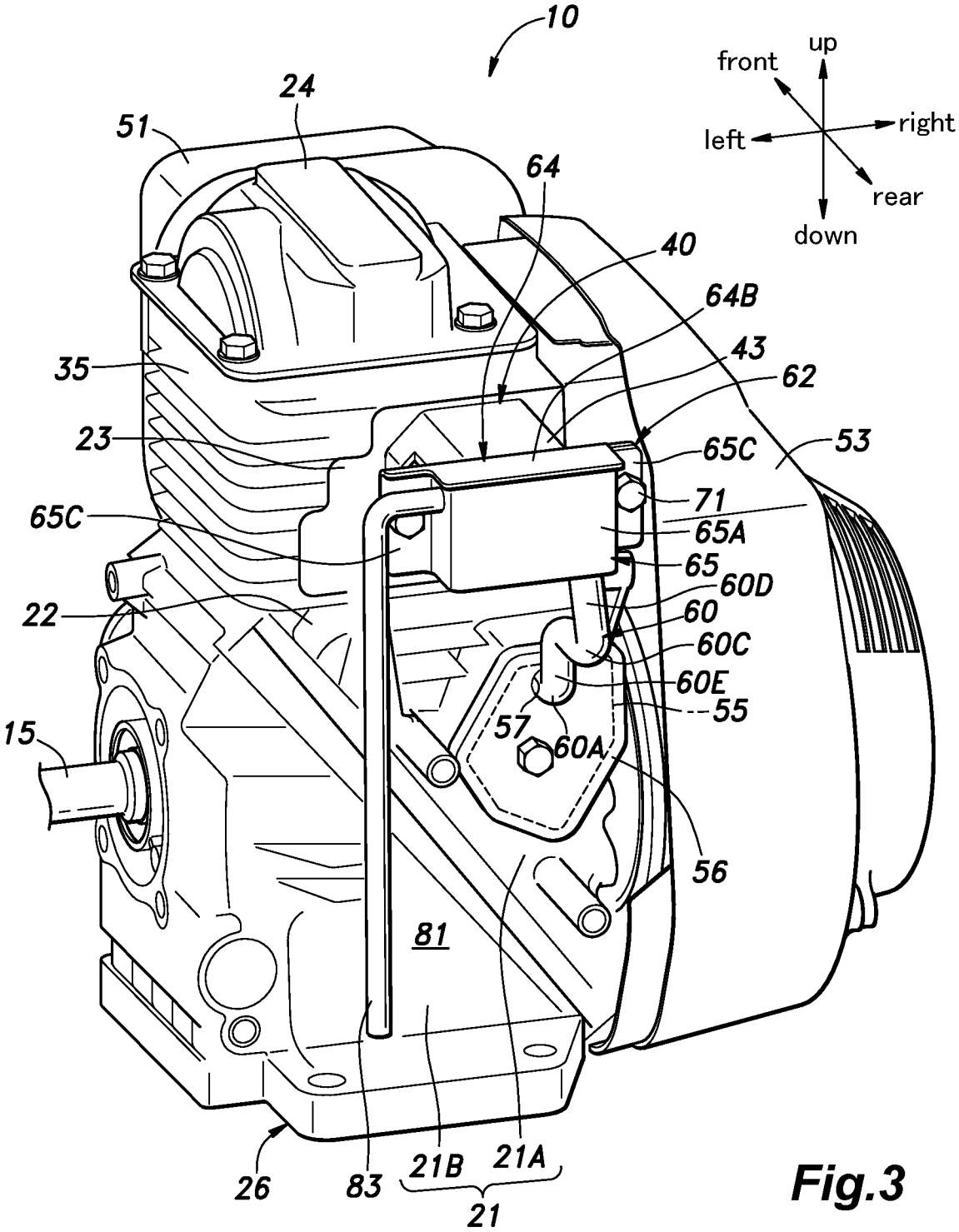
FIG. 3 is a perspective view of the internal combustion engine.
Figure 4A:
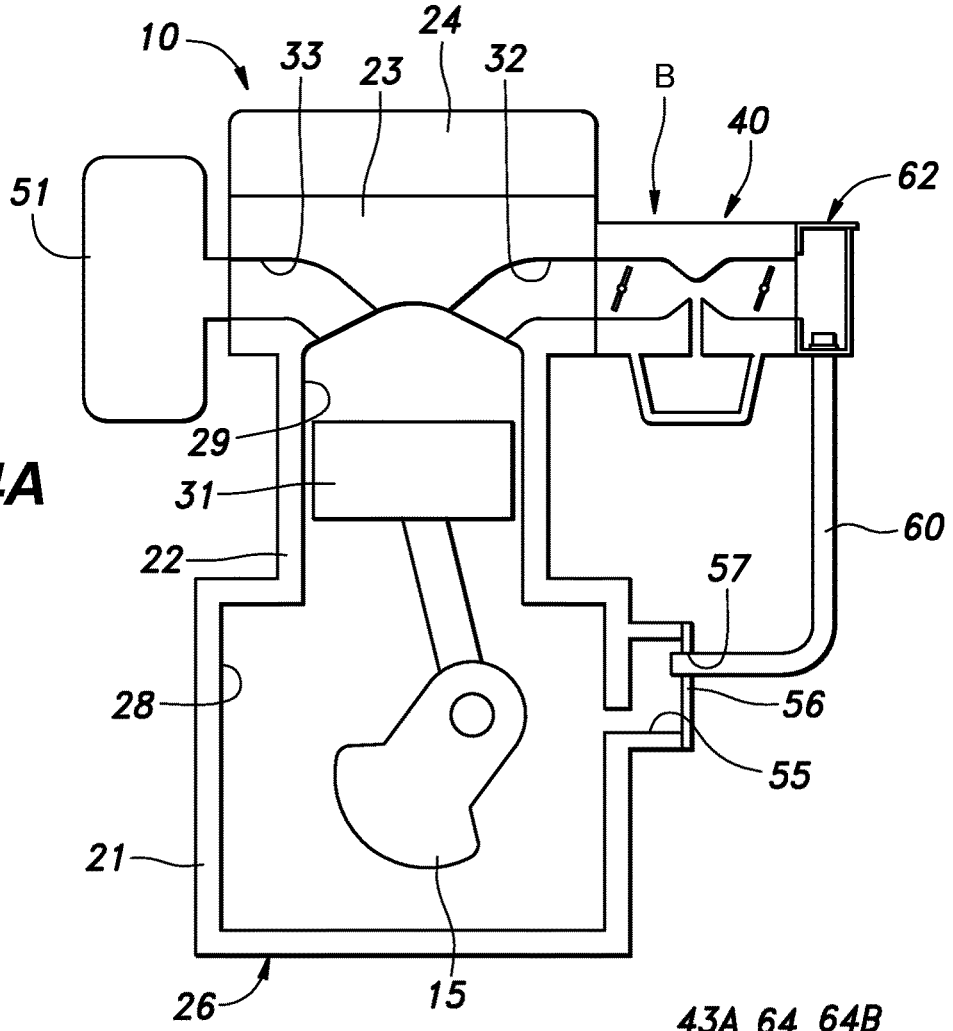
FIG. 4A is a schematic sectional view of the internal combustion engine.

As shown in FIGS. 3 and 4A, the internal combustion engine 10 consists of a single-cylinder four-stroke engine, and is provided with an internal combustion engine main body 26 that includes a crankcase 21, a cylinder block 22 provided on top of the crankcase 21, a cylinder head 23 provided on top of the cylinder block 22, and a head cover 24 provided on top of the cylinder head 23. The crankcase 21 internally defines a crank chamber 28 that houses the crankshaft 15.

The cylinder block 22 internally defines a cylinder 29 communicating with the crank chamber 28. A piston 31 is slidably received in the cylinder 29. The piston 31 is connected to the crankshaft 15 via a connecting rod. The cylinder head 23 that closes the upper end of the cylinder 29 is provided with an intake port 32 and an exhaust port 33 that communicate with the combustion chamber formed by the cylinder 29. The head cover 24 defines a valve actuation chamber jointly with the cylinder head 23. In the present embodiment, the internal combustion engine 10 is a single cylinder engine, but may also be a multi-cylinder engine.

In the present embodiment, the crankcase 21 consists of a first case half 21A and a second case half 21B that are joined to each other about a surface obliquely intersecting the axis of the crankshaft 15. The first case half 21A, the cylinder block 22, and the cylinder head 23 form an integrally cast member or an upper block 35. The second case half 21B and the head cover 24 consist of separate members fastened to the upper block 35.

The internal combustion engine main body 26 is attached to the main body frame 5 such that the cylinder axis thereof is substantially parallel to the vertical direction and the crank axis extends laterally. Note that the cylinder axis of the internal combustion engine 10 may be slightly inclined backward depending on the operating condition of the snow blower 1. The intake port 32 is provided on the rear side of the cylinder head 23, and the exhaust port 33 is provided on the front side of the cylinder head 23.

Figure 4B:
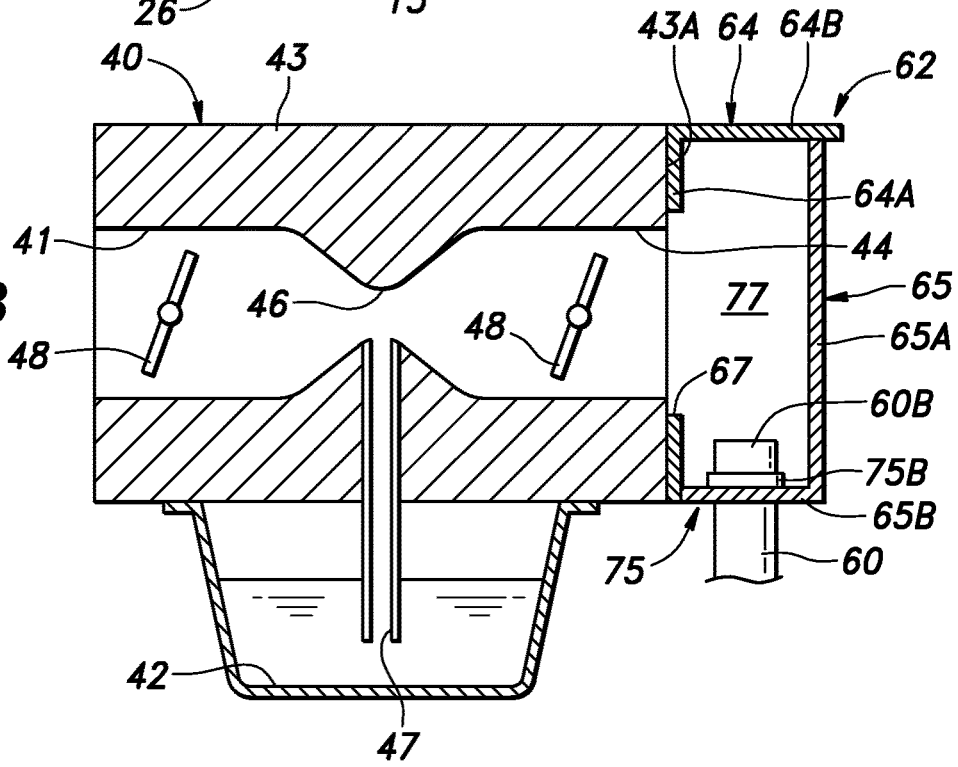
FIG. 4B is an enlarged view of a part indicated by letter B in FIG. 4A.

A carburetor 40 is provided on the rear side of the cylinder head 23. As shown in FIG. 4B, the carburetor 40 is provided with a carburetor body 43 that internally defines an intake passage 41 extending in the fore and aft direction, and a fuel chamber 42 positioned under the intake passage 41. The rear end of the intake passage 41 opens rearward at a rear wall 43A of a carburetor body 43 of the carburetor 40, and forms an air inlet port 44. The carburetor body 43 is fastened to the cylinder block 22, and the front end of the intake passage 41 is connected to the intake port 32. In another embodiment, the carburetor body 43 is connected to the cylinder block 22 via an intake pipe or a passage member, instead of being directly connected to the intake port 32.

A venturi 46 is formed in a middle part of the intake passage 41. A fuel supply passage 47 extending from the fuel chamber 42 has an open end located in the venturi 46. A pair of butterfly valves 48 are provided before and after the venturi 46 of the intake passage 41, respectively.

As shown in FIGS. 3 and 4A, a muffler 51 connected to the exhaust port 33 is provided on the front side surface of the cylinder head 23. The right end of the crankshaft 15 projecting rightward from the right end surface of the crankcase 21 is fitted with a flywheel, a cooling fan, and a recoil starter in a per se known manner. An engine cover 53 is provided on the right side of the crankcase 21 to cover the flywheel, the cooling fan, and the recoil starter. The engine cover 53 forms a cooling air passage jointly with the internal combustion engine main body 26. The cooling air drawn into the cooling air passage by the cooling fan cools the internal combustion engine main body 26. The left end of the crankshaft 15 projecting leftward from the left side surface of the crankcase 21 is fitted with a pulley forming a part of the belt and pulley mechanism 16.

A breather chamber 55 communicating with the crank chamber 28 is formed on the rear side of the crankcase 21. The breather chamber 55 is formed by a recess formed on the rear side of the crankcase 21 and a lid 56 closing the recess. A plurality of partition walls (baffle plates) are provided in the breather chamber 55 so that a meandering flow path is defined. The lid 56 is provided with an outlet hole 57 that is passed through the lid 56 and communicates with the breather chamber 55. An inlet end 60A of a breather tube 60 is connected to the outlet hole 57.

A cover member 62 is fastened to the rear wall 43A of the carburetor body 43. The cover member 62 is formed of a fire-resistant resin material or metal material. For example, the cover member 62 may be formed of a sheet metal member. The cover member 62 has a front wall 65A that faces the air inlet port 44 of the carburetor 40 via a certain gap. The cover member 62 has a function of protecting other members from backfire that may issue from the air inlet port 44 of the carburetor 40.

Figure 5:
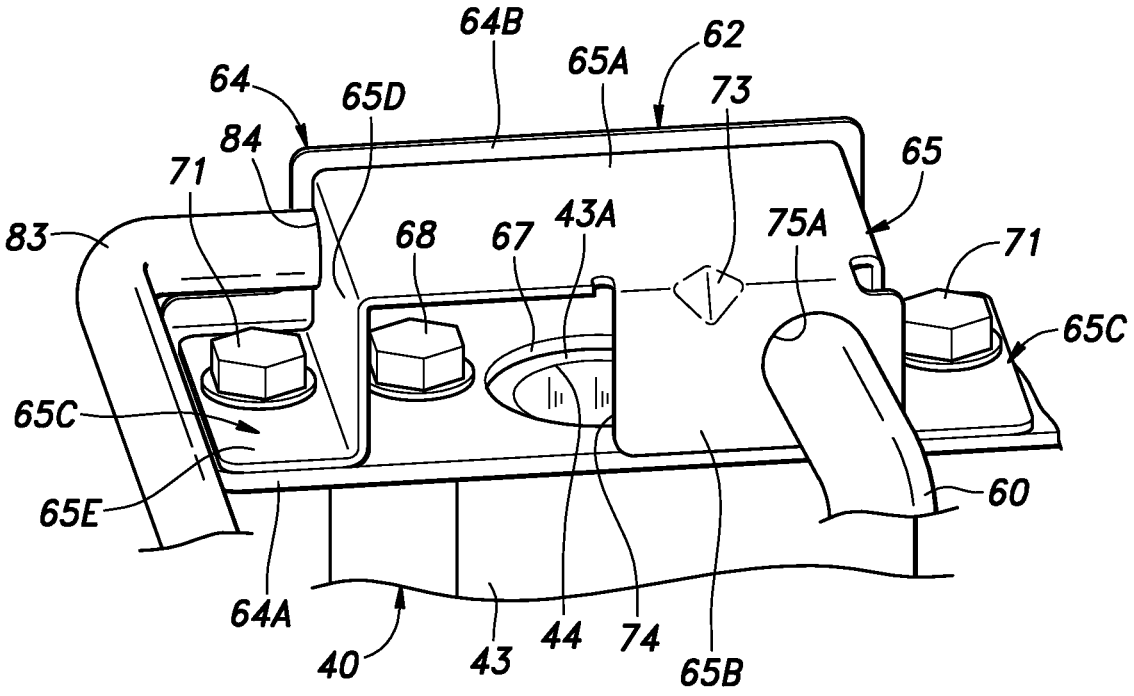
FIG. 5 is a perspective view of a carburetor and a cover member of the internal combustion engine as viewed from below.
Figure 6:
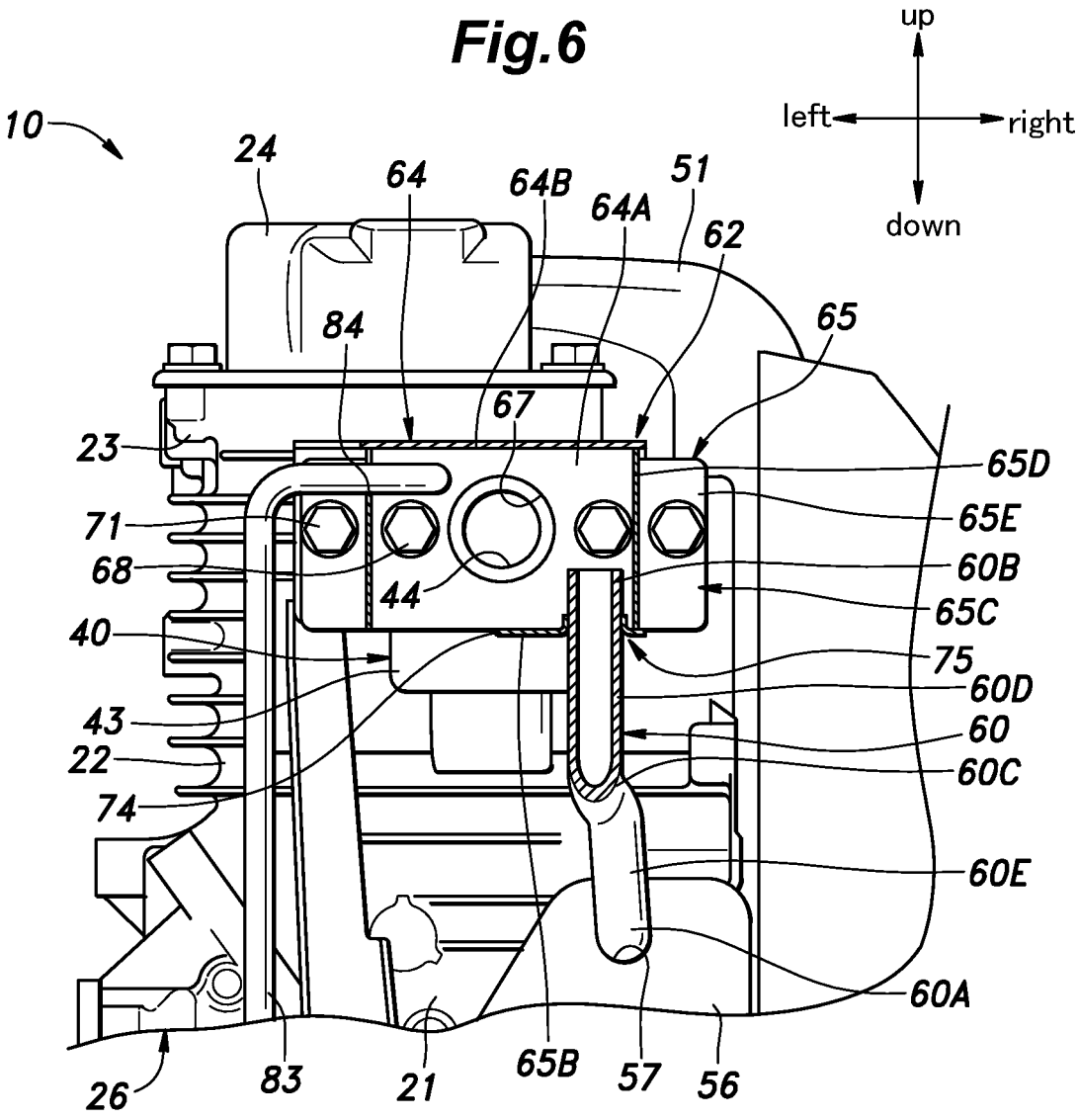
FIG. 6 is a fragmentary rear view of the internal combustion engine partly in section.

In the present embodiment, as shown in FIGS. 5 and 6, the cover member 62 includes a first member 64 and a second member 65 fastened to the first member 64. The first member 64 includes a base plate 64A fastened to the rear surface of the carburetor body 43. The base plate 64A has a major plane facing in the fore and aft direction, and extends along the rear wall 43A of the carburetor body 43. The base plate 64A is provided with a through hole 67 at a part thereof facing the air inlet port 44. The through hole 67 is formed substantially in the same shape (conformal) as the air inlet port 44 and is connected to the air inlet port 44. The base plate 64A is fastened to the rear wall 43A of the carburetor body 43 by a pair of bolts 68 arranged on the left and right of the through hole 67. The left end of the base plate 64A protrudes leftward from the left end of the rear wall 43A of the carburetor body 43, and the right end of the base plate 64A protrudes rightward from the right end of the rear wall 43A of the carburetor body 43.

The first member 64 has an upper wall 64B protruding from the upper edge of the base plate 64A in a direction (rearward) facing away from the carburetor body 43. The upper wall 64B is formed in a plate shape, and has a major plane facing vertically. The base plate 64A and the upper wall 64B may be formed by bending a continuous piece of metal plate. The upper wall 64B is bent relative to the base plate 64A by about 90 degrees, and extends laterally along the upper edge of the base plate 64A.

As shown in FIGS. 5 to 8, the second member 65 includes the front wall 65A facing the base plate 64A via a gap, a lower wall 65B extending from the lower edge of the front wall 65A toward the base plate 64A, and a pair of legs 65C extending from the lateral sides of the front wall 65A toward the base plate 64A and fastened to the base plate 64A. The free end of the upper wall 64B of the first member 64 extends beyond the upper edge of the front wall 65A, and the upper edge of the front wall 65A abuts against or in close proximity to the upper wall 64B. The front wall 65A, the lower wall 65B, and the legs 65C are formed by bending a continuous piece of metal plate.

The front wall 65A has a plate shape having a major plane facing in the fore and aft direction, and opposes the air inlet port 44 and the through hole 67. When viewed from the axial direction of the air inlet port 44, the front wall 65A is larger than the air inlet port 44. In other words, when viewed from the axial direction of the air inlet port 44, the entire area of the air inlet port 44 overlaps the front wall 65A.

Each leg 65C includes a side wall 65D extending substantially perpendicular from the corresponding side edge of the front wall 65A toward the base plate 64A, and a flange 65E extending substantially perpendicular from the free end edge of the side wall 65D and abutting onto the base plate 64A. The flange 65E is provided with a mounting hole, and is fastened to the base plate 64A (or the part thereof extending laterally beyond the corresponding side end of the carburetor body 43) by a fastener such as a bolt 71. Each side wall 65D has a laterally facing major plane, and has a substantially same vertical expanse as the front wall 65A.

Figure 8:
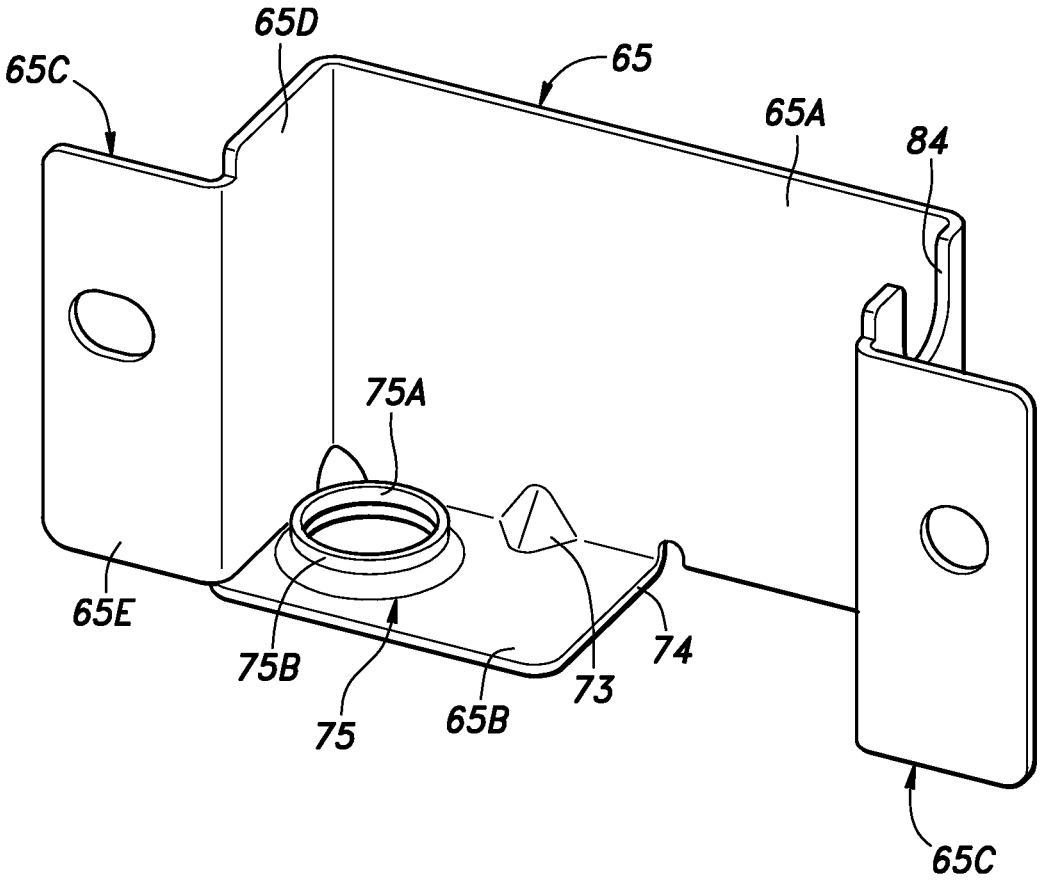
FIG. 8 is a perspective view of a second member of the cover member.

As shown in FIG. 8, the lower wall 65B is formed in a plate shape having a vertically facing major plane. The lower wall 65B extends substantially perpendicularly to the front wall 65A toward the base plate 64A, and also extends laterally along the lower edge of the front wall 65A. The lower wall 65B is formed by being bent from the front wall 65A. A reinforcing rib 73 is formed at a boundary between the lower wall 65B and the front wall 65A so that the relative angle between the lower wall 65B and the front wall 65A may remain fixed.

The lower wall 65B has a cover member opening 74 that is passed thorough vertically, and a tube support portion 75 that supports the outlet end 60B of the breather tube 60. In the present embodiment, the cover member opening 74 is formed as a rectangular cutout extending from the side edge of the lower wall 65B, and is positioned on the left hand side of the lower wall 65B. The tube support portion 75 is disposed on the part of the lower wall 65B located on the right side of the cover member opening 74. The tube support portion 75 includes a support hole 75A vertically passed through the lower wall 65B, and a cylindrical boss portion 75B protruding upward from the peripheral edge of the support hole 75A. When the second member 65 is formed from a metal plate, the tube support portion 75 may be formed by burring. The tube support portion 75 may also be provided on the front wall 65A or the side wall 65D.

By fastening the first member 64 and the second member 65 to each other, a space 77 surrounded by the base plate 64A, the front wall 65A, the upper wall 64B, the two legs 65C, and the lower wall 65B is defined. The space 77 is located between the rear wall 43A of the carburetor body 43 and the front wall 65A. The upper wall 64B covers the gap between the front wall 65A and the carburetor 40 from above. It is preferable that the free end of the upper wall 64B is in contact with the front wall 65A and the legs 65C, but a slight gap may be formed between the upper wall 64B and the front wall 65A and/or between upper wall 64B and the legs 65C. Similarly, it is preferable that the lower wall 65B is in contact with the base plate 64A and/or one of the legs 65C, but a slight gap may be formed between the lower wall 65B and the base plate 64A and/or between the lower wall 65B and one of the legs 65C.

As shown in FIG. 6, the outlet end 60B of the breather tube 60 is inserted into the tube support portion 75 from below and fixed therein. Thus, the outlet end 60B of the breather tube 60 is supported by the cover member 62. In the present embodiment, the outlet end 60B of the breather tube 60 is fixed to the tube support portion 75 by its own elasticity. In another embodiment, the outlet end 60B of the breather tube 60 is fixed to the tube support portion 75 by an adhesive, a stopper, or the like.

The breather tube 60 is placed substantially vertically along the cylinder block 22 with a slightly spaced relationship to the cylinder block 22. The breather tube 60 has a bent portion 60C between the inlet end 60A and the outlet end 60B. The section of the breather tube 60 downstream of the bent portion 60C (on the side of the inlet end 60A) may be referred to as a downstream portion 60D, and the section of the breather tube 60 upstream of the bent portion 60C (on the side of the outlet end 60B) may be referred to as an upstream portion 60E. The gap between the breather tube 60 and the cylinder block 22 is larger in the downstream portion 60D than in the upstream portion 60E. Therefore, the downstream portion 60D receives less heat from the cylinder block 22 than the upstream portion 60E so that the temperature of the blow-by gas drawn into the carburetor 40 decreases so that the volumetric efficiency of the internal combustion engine 10 increases, and the combustion efficiency improves. In order to minimize the length of the breather tube 60, the bent portion 60C may be omitted. In this embodiment, the carburetor 40, the cover member 62 and the breather tube 60 are arranged inside the outer cover 11.

The outlet end 60B of the breather tube 60 is passed through the tube support portion 75 and the outlet end opening of the breather tube 60 faces upward. The outlet end 60B of the breather tube 60 projects above the upper surface of the lower wall 65B. The outlet end 60B of the breather tube 60 is disposed in the space 77 defined between the front wall 65A and the rear wall 43A of the carburetor 40. The outlet end 60B or, more precisely, the outlet end opening of the breather tube 60 is disposed below the center of the air inlet port 44.

Figure 7:
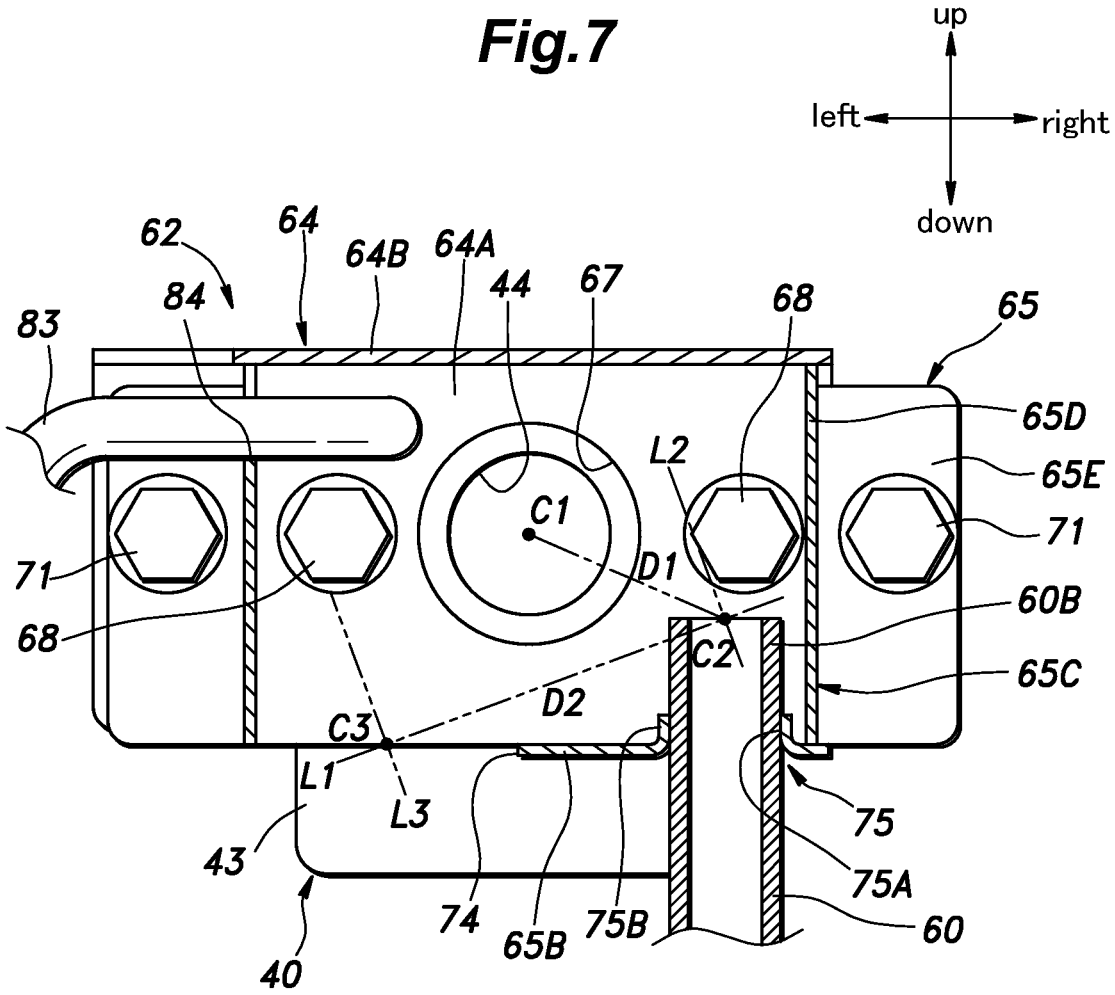
FIG. 7 is an enlarged sectional view of the cover member.

As shown in FIG. 7, the center C1 of the air inlet port 44 of the carburetor 40 is located, as viewed from an axial direction of the air inlet port 44, between a second line L2 which is orthogonal to a first line L1 extending between the center C2 of an outlet end opening of the outlet end 60B of the breather tube 60 and the center C3 of the cover member opening 74 and extends through the center C2 of the outlet end opening of the breather tube 60, and a third line L3 orthogonal to the first line L1 and extending through the center C3 of the cover member opening 74. The distance D1 between the center C2 of the outlet end opening of the outlet end 60B of the breather tube 60 and the center C1 of the air inlet port 44 is shorter than the distance D2 between the center C2 of the outlet end opening of the outlet end 60B of the breather tube 60 and the center C3 of the cover member opening 74.

Preferably, the air inlet port 44 of the carburetor 40 and the cover member opening 74 are dimensioned so that the space 77 defined by the cover member 62 jointly with an outer surface of the carburetor body 43 is placed under a negative pressure due to a reciprocating movement of a piston 31 of the internal combustion engine 10.

As shown in FIG. 3, an open space 81 is formed under the cover member 62 so that liquid that could be discharged from the cover member 62 may not contaminate or otherwise adversely affect a component part or a part of the internal combustion engine 10. In other words, components or parts of the internal combustion engine 10 which are required to avoid contact with the liquid that could be discharged from the cover member 62 are positioned outside of this open space 81.

As shown in FIGS. 6 and 8, a notch 84 is formed in the upper edge of the side wall 65D of one of the legs 65C of the second member 65 remote from the tube support portion 75. The notch 84 defines a hole through which a vent tube 83 is passed in cooperation with the upper wall 64B of the first member 64. The vent tube 83 extends vertically along the rear side of the cylinder block 22, and has an upper end which is passed through this notch 84 and connected to an upper part of a fuel chamber of the carburetor 40, and a lower end which communicates with the atmosphere.

The mode of operation of this internal combustion engine 10 is described in the following. The blow-by gas generated in the crank chamber 28 is discharged therefrom via the breather chamber 55 and the inlet end of the breather tube 60, and is then expelled into the space 77 defined by the cover member 62 via the outlet end 60B of the breather tube 60. Thereafter, the blow-by gas is drawn into the air inlet port 44 by the negative pressure generated at the air inlet port 44, and is supplied to the cylinder 29 through the carburetor 40 and the intake port 32. The cover member 62 which has the primary function of protecting other members from backfire that can issue from the air inlet port 44 of the carburetor 40 supports the outlet end of the breather tube 60 as the secondary function thereof. Thus, the outlet end of the breather tube 60 can be positioned on the upstream side of the carburetor 40 without forming an intake passage by using various component parts. Further, since the outlet end 60B of the breather tube 60 is disposed between the front wall 65A of the cover member 62 and the carburetor body 43, the blow-by gas flowing out of the outlet end of the breather tube 60 is prevented from being released to the atmosphere.

Since the cover member opening 74 is formed in the lower wall 65B, the air can be supplied to the carburetor 40 through the cover member opening 74, and the liquid such as oil that may be deposited inside the cover member 62 is discharged to the outside through the cover member opening 74. Since an open space 81 in which no essential device such as an electric device is placed is formed below the cover member 62, even if liquid should drip down from the cover member 62, essential devices are protected from the deposition of such liquid.

Since the outlet end 60B of the breather tube 60 is disposed higher than the inlet end 60A thereof, and supported by the tube support portion 75 in such a manner that the opening of the outlet end 60B of the breather tube 60 faces upward, liquid such as oil which may be deposited in the breather tube 60 is caused to flow downward toward the inlet end 60A of the breather tube 60 under the gravitational force. As a result, liquid such as oil is prevented from being discharged from the outlet end 60B of the breather tube 60 to the interior of the cover member 62.

The outlet end 60B of the breather tube 60 protrudes above the upper surface of the lower wall 65B, and is positioned near the air inlet port 44. As a result, the blow-by gas can be prevented from flowing out of the space 77 defined in the cover member 62. Further, since the outlet end 60B of the breather tube 60 is disposed below the center of the air inlet port 44, liquid which may be discharged from the outlet end 60B of the breather tube 60 is prevented from being drawn into the air inlet port 44.

The center C1 of the air inlet port 44 of the carburetor 40 is located, as viewed from an axial direction of the air inlet port 44, between a second line L2 which is orthogonal to a first line L1 extending between the center C2 of the outlet end opening of the outlet end 60B of the breather tube 60 and the center C3 of the cover member opening 74 and extends through the center C2 of the outlet end opening of the breather tube 60, and a third line L3 orthogonal to the first line L1 and extending through the center C3 of the cover member opening 74. The distance D1 between the center C2 of the outlet end opening of the breather tube 60 and the center C1 of the air inlet port 44 is shorter than the distance D2 between the center C2 of the outlet end opening of the outlet end 60B of the breather tube 60 and the center C3 of the cover member opening 74. Therefore, the blow-by gas is prevented from being released to the outside of the cover member 62 through the cover member opening 74.

Since the breather tube 60 is arranged inside the outer cover 11, the breather tube 60 is protected from the influences of the outside air temperature. Therefore, it is possible to prevent the moisture contained in the blow-by gas from freezing in the breather tube 60.

Even when the carburetor body 43 is so small that there is no available surface area to which the second member 65 can be fastened, owing to the use of the first member 64, the cover member 62 can be attached to the carburetor body 43 to define the space 77 for positioning the outlet end 60B of the breather tube 60.

Figure 9:
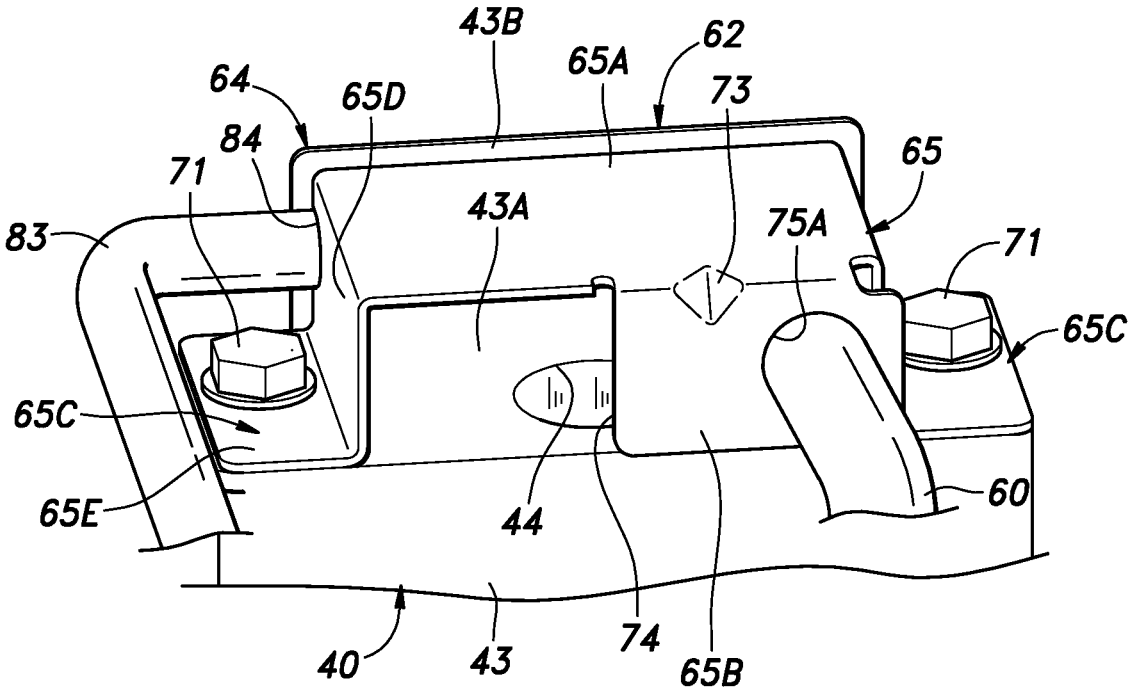
FIG. 9 is a view similar to FIG. 5 showing a cover member according to a second embodiment of the present invention.

FIG. 9 show a cover member 62 according to a second embodiment of the present invention. In this embodiment, the cover member 62 consists solely of the second member 65. The legs 65C are directly fastened to the rear wall 43A of the carburetor body 43. The upper wall 64B in this case extends from the carburetor body 43 to fill the gap between the upper edge of the front wall 65A and the rear wall 43A of the carburetor body 43.

Figure 10:
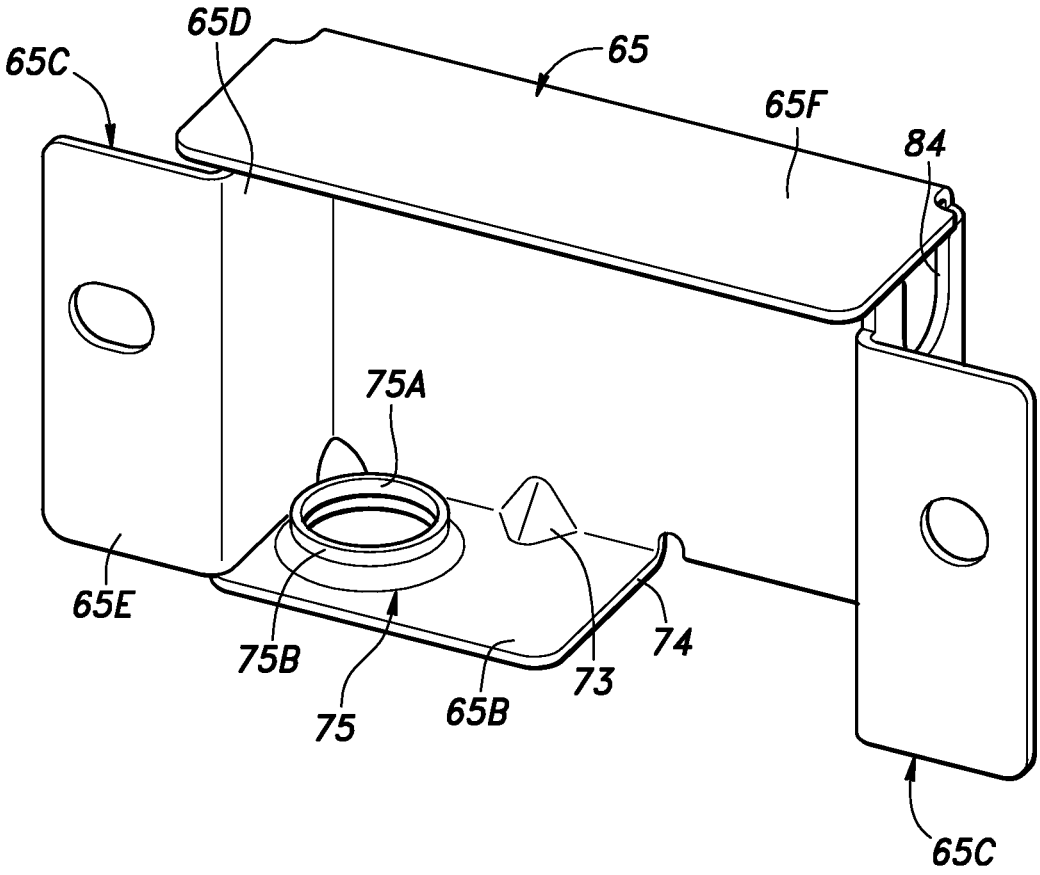
FIG. 10 is a view similar to FIG. 8 showing a cover member according to a third embodiment of the present invention.

FIG. 10 shows a cover member 62 according to a third embodiment of the present invention. In this embodiment also, the cover member 62 consists solely of the second member 65. Instead of the upper wall 43B extending from the carburetor body 43, an upper wall 65F extends from the upper edge of the front wall 65A toward the rear wall 43A of the carburetor body 43.

In the foregoing embodiments, the internal combustion engine 10 according to the present invention was applied to a snow blower 1. However, the internal combustion engine 10 can also be applied to other work devices such as cultivators, weed cutters, sprayers, so on.

The invention claimed is:

1. An internal combustion engine comprising an internal combustion engine main body that includes a crankcase, a cylinder block provided on top of the crankcase, a cylinder head provided on top of the cylinder block, and a head cover provided on top of the cylinder head, the internal combustion engine main body is attached to a main body frame such that the cylinder axis thereof is substantially parallel to the vertical direction and the crank axis extends in left and right direction, characterized in that the internal combustion engine further comprises:

a carburetor provided on the rear side of the cylinder head and having an intake passage extending in the fore and aft direction, the front end of the intake passage being connected to an intake port of the internal combustion engine main body and the rear end of the intake passage forming an air inlet port;

a fire-resistant cover member having a front wall facing the air inlet port via a gap, the front wall having a plate shape having a major plane facing in the fore and aft direction; and a breather tube having an inlet end connected to a crank chamber of the internal combustion engine main body, and an outlet end supported by the cover member at a position located between the front wall and the carburetor, wherein the upper and lower directions are along the vertical direction, the fore and aft directions are perpendicular to the vertical direction, and the left and right directions are perpendicular to the vertical direction and front and rear directions, wherein the cover member further includes a lower wall extending from a lower edge of the front wall toward the carburetor, and having a cover member opening passed vertically through the lower wall.

2. The internal combustion engine according to claim 1, wherein an open space is defined under the cover member.

3. The internal combustion engine according to claim 1, wherein the lower wall is provided with a tube supporting portion receiving the outlet end of the breather tube therein, and the outlet end of the breather tube is located higher than the inlet end of the breather tube, the outlet end of the breather tube having an outlet end opening facing upward.

4. The internal combustion engine according to claim 3, wherein the outlet end of the breather tube projects upward from an upper surface of the lower wall.

5. The internal combustion engine according to claim 4, wherein the outlet end opening of the breather tube is located lower than a center of the air inlet port of the carburetor.

6. The internal combustion engine according to claim 3, wherein a center of the air inlet port of the carburetor is located, as viewed from an axial direction of the air inlet port, between a second line which is orthogonal to a first line extending between a center of the outlet end opening of the outlet end of the breather tube and a center of the cover member opening and extends through the center of the outlet end opening of the breather tube, and a third line orthogonal to the first line and extending through the center of the cover member opening.

7. The internal combustion engine according to claim 3, wherein a distance between a center of the outlet end opening of the breather tube and a center of the air inlet opening of the carburetor is smaller than a distance between the center of the outlet end opening of the breather tube and a center of the cover member opening.

8. The internal combustion engine according to claim 1, wherein the air inlet port of the carburetor and the cover member opening are dimensioned so that a space defined by the cover member jointly with an outer surface of the carburetor is placed under a negative pressure due to a reciprocating movement of a piston of the internal combustion engine.

9. The internal combustion engine according to claim 1, further comprising an outer cover covering the internal combustion engine main body, wherein the carburetor, the cover member and the breather tube are placed inside the outer cover.

10. The internal combustion engine according to claim 1, wherein the cover member is made of stamp formed sheet metal.

11. The internal combustion engine according to claim 10, wherein the cover member is provided with a pair of legs extending from lateral sides of the front wall and attached to the carburetor, and an upper wall extending from an upper edge of the front wall to a part at least adjoining an outer surface of the carburetor or from the carburetor to a part at least adjoining the front wall.

12. The internal combustion engine according to claim 10, wherein the air inlet port of the carburetor faces in a lateral direction, and the cover member includes a first member and a second member fastened to the first member, wherein the first member includes a base plate secured to an end surface of the carburetor and having a through hole communicating with the air inlet port of the carburetor, and an upper wall extending from an upper edge of the base plate away from the carburetor, and the second member includes the front wall opposing the base plate, a lower wall extending from a lower edge of the front wall toward the base plate, and a pair of legs extending from either side edge of the front wall and attached to the base plate, the lower wall being provided with a cover member opening passed vertically therethrough.

* * * * *